US005331830A

United States Patent [19]

Su

[11] Patent Number: 5,331,830

[45] Date of Patent: Jul. 26, 1994

[54] CYLINDRICAL LOCK

[76] Inventor: Mao C. Su, 85 Hsin Min Road Ya Liao Village, Lu Chu Hsiang, Kaohsiung Hsien, Taiwan

[21] Appl. No.: 12,952

[22] Filed: Feb. 3, 1993

[51] Int. Cl.[5] ..... E05B 67/24

[52] U.S. Cl. ..... 70/38 A; 70/39

[58] Field of Search ..... 70/38 A, 38 R, 39, 24–26, 70/233

[56] References Cited

U.S. PATENT DOCUMENTS

| | | | |
|---|---|---|---|
| 3,735,612 | 5/1973 | Popovici | 70/38 A |
| 4,085,600 | 4/1978 | Bindari | 70/39 |
| 4,551,997 | 11/1985 | Huang | 70/38 A |
| 4,621,509 | 11/1986 | Mizuno | 70/26 |
| 4,881,387 | 9/1989 | Kortenbrede | 70/39 |
| 5,142,888 | 9/1992 | Ling | 70/26 |
| 5,189,893 | 3/1993 | Kortenbrede | 70/38 A |
| 5,195,340 | 3/1993 | Huang | 70/38 A |

FOREIGN PATENT DOCUMENTS

| | | | |
|---|---|---|---|
| 2141170 | 12/1984 | United Kingdom | 70/38 A |

*Primary Examiner*—Peter M. Cuomo
*Assistant Examiner*—Darnell M. Boucher

[57] ABSTRACT

A cylindrical lock comprising an U-shaped shackle, a cylindrical housing containing a hollow tube consisting of two elongate semi-round plates and a lock member, two legs of the shackle having a cone-shaped end and two inclined slots to pushingly insert in two holes in the hollow tube to engage stopping edges of the two notches of the elongate plates through opposite movement of the two elongate plates for locking and the stopping edges of the two notches disengaging from the slots of the shackle by movement of the two elongate plates moved by the lock member rotated by a key.

1 Claim, 8 Drawing Sheets

CYLINDRICAL LOCK

BACKGROUND OF THE INVENTION

A conventional cylindrical lock shown in FIGS. 1 and 2 comprises an U-shaped shackle 10, a cylindrical housing 12 and a lock member 17. For locking it, a leg 11 of the shackle 10 is inserted in an oval-shaped hole 120 in the housing 12, letting a curved-in notch 110 of the leg 11 engage a projection 14 of the end of the cylindrical housing 12 and an end of another leg 15 insert in a round hole 121 of the housing 12. Then a key 16 is used to rotate the lock member 17, making a projecting block 18 also rotate to move up a stop plate 19 so as to engage a slot 150 in the end of the leg 15, and consequently the shackle 10 is locked immovable, impossible to be pulled out of the housing 12.

If this lock in position is to be unlocked, i.e. to free the shackle 12 from the housing 12, a key 16 has to rotate the lock member 17, moving the stop plate 19 down to the original position, and the shackle 10 is to be pushed to incline to the left, disengaging the curved-in notch 110 from the projection 14 and then the shackle 10 can be pulled out of the housing 12.

This conventional cylindrical lock has been found to have drawbacks listed below.

1. In locking process, the shackle has to be inserted inclinedly in the housing in order to engage the curved-in notch 110 of the shackle 12 with the projection 14 of the cylinder 12.

2. The key has to be used to rotate the lock member so as to move down the stop plate 19 for the leg 15 of the shackle 10 to insert in the hole 121 of the housing 12.

3. The U-shaped shackle has to be inserted in the holes of the housing 12 in a precise position that the leg 11 is at the left side and the leg 15 is at the right side, otherwise it can not be locked, because the notch 110 and the slot 150 in the two leg ends have different forms and direction.

4. The stop plate only locks one leg 15 of the shackle 10, so this lock has not excellent anti-burglary safety.

5. In unlocking, the shackle 10 has to be inclined to a large angle, so this conventional lock has a restriction for places where it is used.

SUMMARY OF THE INVENTION

One object of this invention is to offer a cylindrical lock, which has a shackle possible to be inserted in a cylindrical housing for locking without using a key to unlock it beforehand.

Another object is to offer a cylindrical lock having a shackle, two legs of which are kept locked at the same time, having stronger safety against burglary.

The main feature of the cylindrical lock is two semi-round elongate plates to form a complete hollow tube to be deposited in of curved notches spaced apart in an upper and a lower edge to correspond to each other, a stopping edge in each notch positioned diagonally to that of the corresponding notch, a slot in a left and a right side of each plate, an inclined groove near a right notch of each plate, a round lateral stopper inside each plate to form a chamber to deposit a coil spring between the two stoppers.

And a lock member has a projecting round block, which is bored with a lateral hole for inserting a slide pin, and both ends of the slide pin are in contact with the inclined grooves of the semi-round elongate plates. Both leg ends of the shackle are shaped as a cone and two inclined notches are provided above the cone-shaped end.

DETAILED DESCRIPTION OF THE INVENTION

Figure 1:
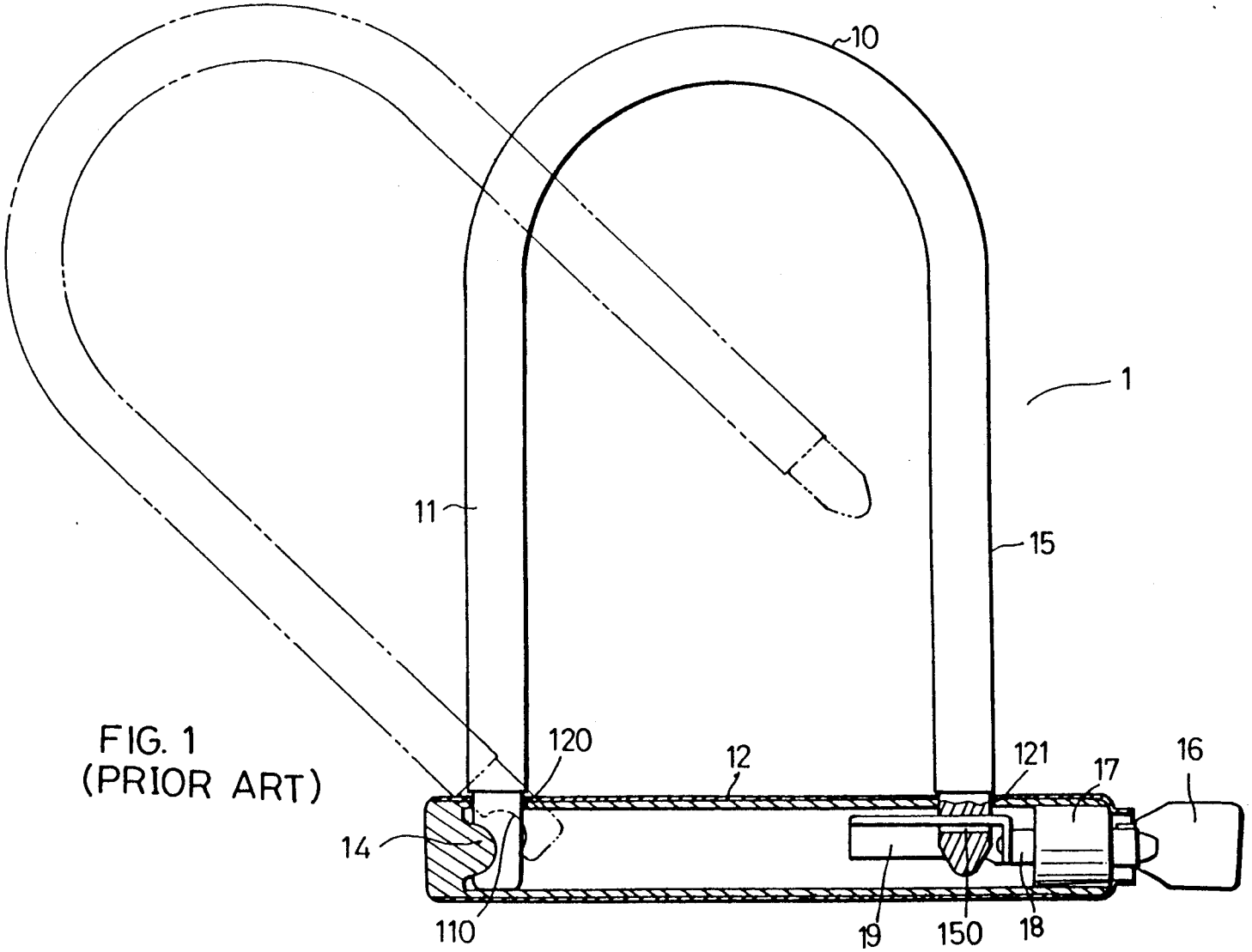
FIG. 1 (PRIOR ART)
FIG. 1 is a perspective view of conventional cylindrical lock.
Figure 2:
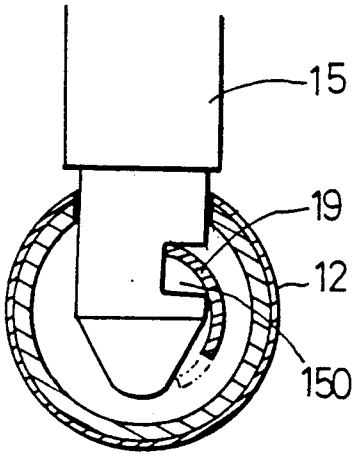
FIG. 2 (PRIOR ART)
FIG. 2 is a cross-sectional view of a shackle end engaged with a stop plate in a cylindrical housing in the conventional cylindrical lock.
Figure 3:
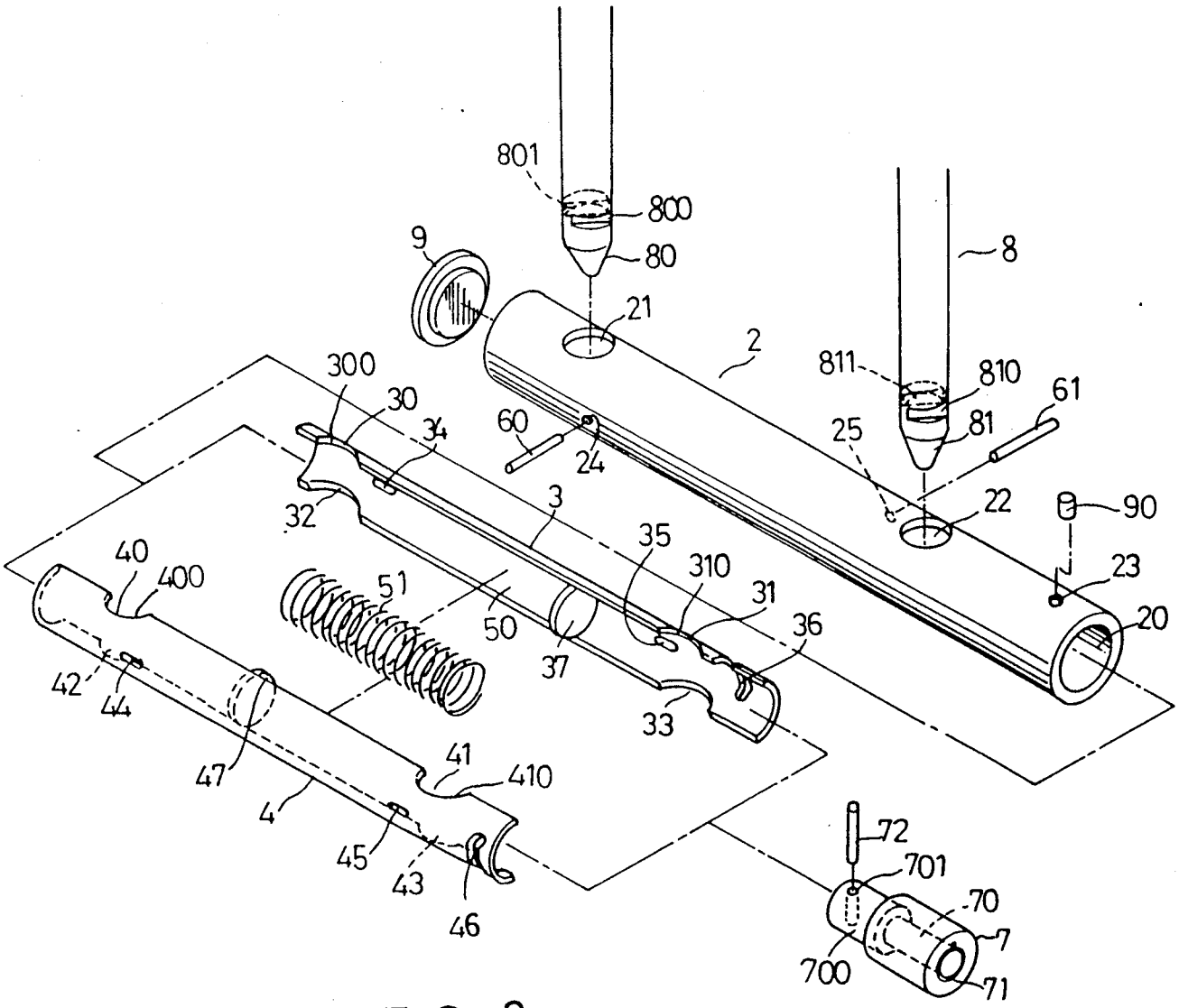
FIG. 3 is an exploded perspective view of a cylindrical lock in the present invention.

A cylindrical lock in the present invention, as shown in FIG. 3, comprises a cylindrical housing 2, two semi-round elongate plates 3, 4 forming a complete tube, a lock member 7, a shackle 8 and a seal cap 9 as main components.

The cylindrical housing 2 is shaped tubular and hollow, having a central longitudinal through hole 20, two shackle holes 21, 22 spaced apart in line for two ends of the shackle 8 to pass through, a round hole 23 to the right of the shackle hole 22 near an end, a pin hole 24 in a left side wall near the shackle hole 21 in a front portion and another pin hole 25 in an upper side wall near the shackle hole 22 in a rear portion.

The two semi-round elongate plates 3, 4 forming a complete tube is deposited in the central longitudinal hole 20 of the housing 2, having curved notches 30, 31, 32, 33, 40, 41, 42, 43 in an upper and a lower edges in corresponding locations, stopping edges 300, 400, 310, 410 in the notches 30, 40, 31, 41, inclined grooves 36, 46 to the right of the notches 31, 41 two round stoppers 37, 47 laterally provided in a hollow hole in a tube formed by the two semi-round elongate plates 3, 4 combined together. And a coil spring 51 is deposited in a chamber 50 formed between the two stoppers 37, 47. Two round pins 60, 61 are inserted respectively in the pin holes 24, 25 and also in the slots 44, 34, 35, 45 to keep the housing 2 combined with the two elongate plates 3, 4 and to limit the plates 3, 4 to move within the length of the slots 44, 34, 35, 45.

The locking member 7 shaped as a round post is deposited in the central hole 20, having a turning member 70 and a projecting round block 700 extending rearward from the turning member 70, a round key hole 71 in a right side, a lateral hole 701 in the projecting round block 700 for a slide pin 72 to fit therein. The projecting round block 700 projects in the inner hole formed by the two elongate plates 3, 4 and both ends of the slide pin 72 are in contact with the two inclined grooves 36, 46 of the plates 3, 4.

The shackle 8 is U-shaped, having two ends inserting in the housing 2, two cone-shaped surfaces 80, 81 in the two ends, two pairs of two inclined notches 800, 801 above the cone-shaped surfaces 80, 81.

The seal cap 9 closes up the left open end of the central longitudinal through hole 20 of the housing 2. A fixing pin 90 is provided to insert in the round hole 23 to keep firmly the lock member 7 in the hole 20.

Figure 4:
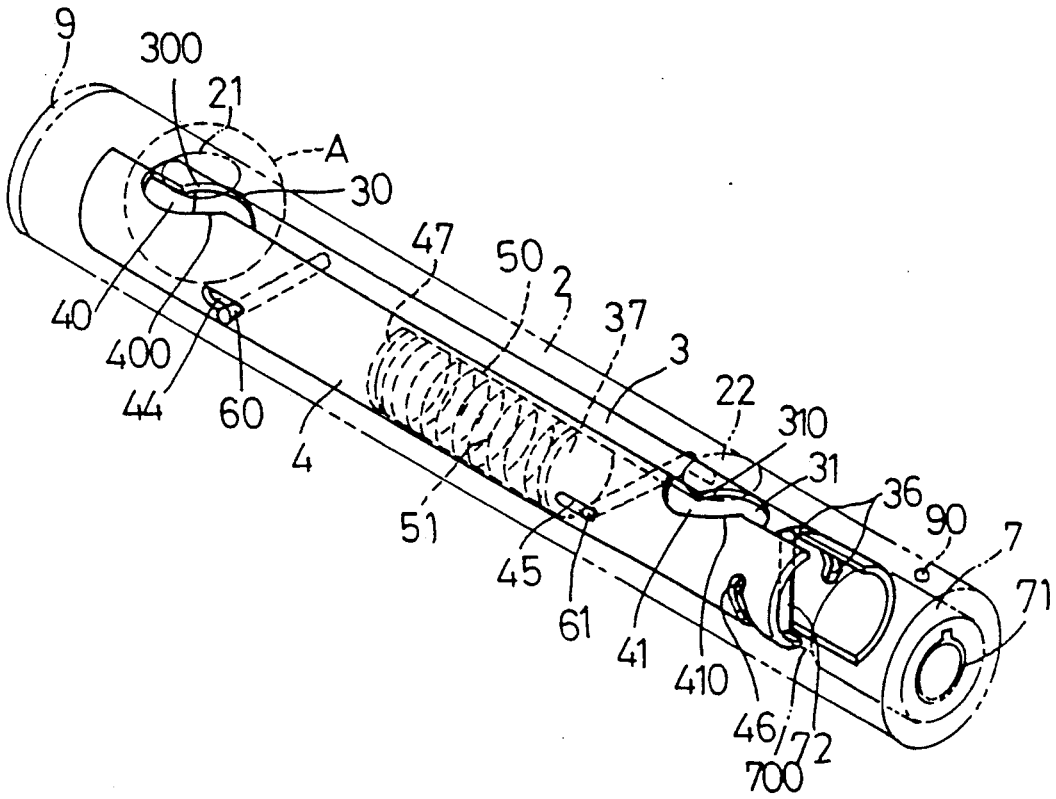
FIG. 4 is a cross-sectional view of the cylindrical lock in the present invention.

In assembling, as shown in FIG. 4, at first, the spring 51 is put inside a tube formed with the two semi-round elongate plates 3, 4 which is combined together, permitting the spring 51 extend between the two stoppers 37, 47, and deposited in the longitudinal through hole 20 of the housing 2. Next, the two pins 60, 61 are respectively inserted in the pin holes 24, 25 and also in the slots 44, 35, 45, and the slide pin 72 is inserted in the hole 701 of the lock member 7, which is then deposited in the longitudinal through hole 20, letting the projecting round block 700 insert in the inner hole of the plates 3, 4 and both ends of the slide pin 72 being in contact with the two inclined grooves 36, 46. Lastly, the fixing pin 90 is inserted through the hole 23 of the housing 2 to fix firmly the lock member 7 in the through hole 20, and then this lock is finished in assemblage.

Figure 5:
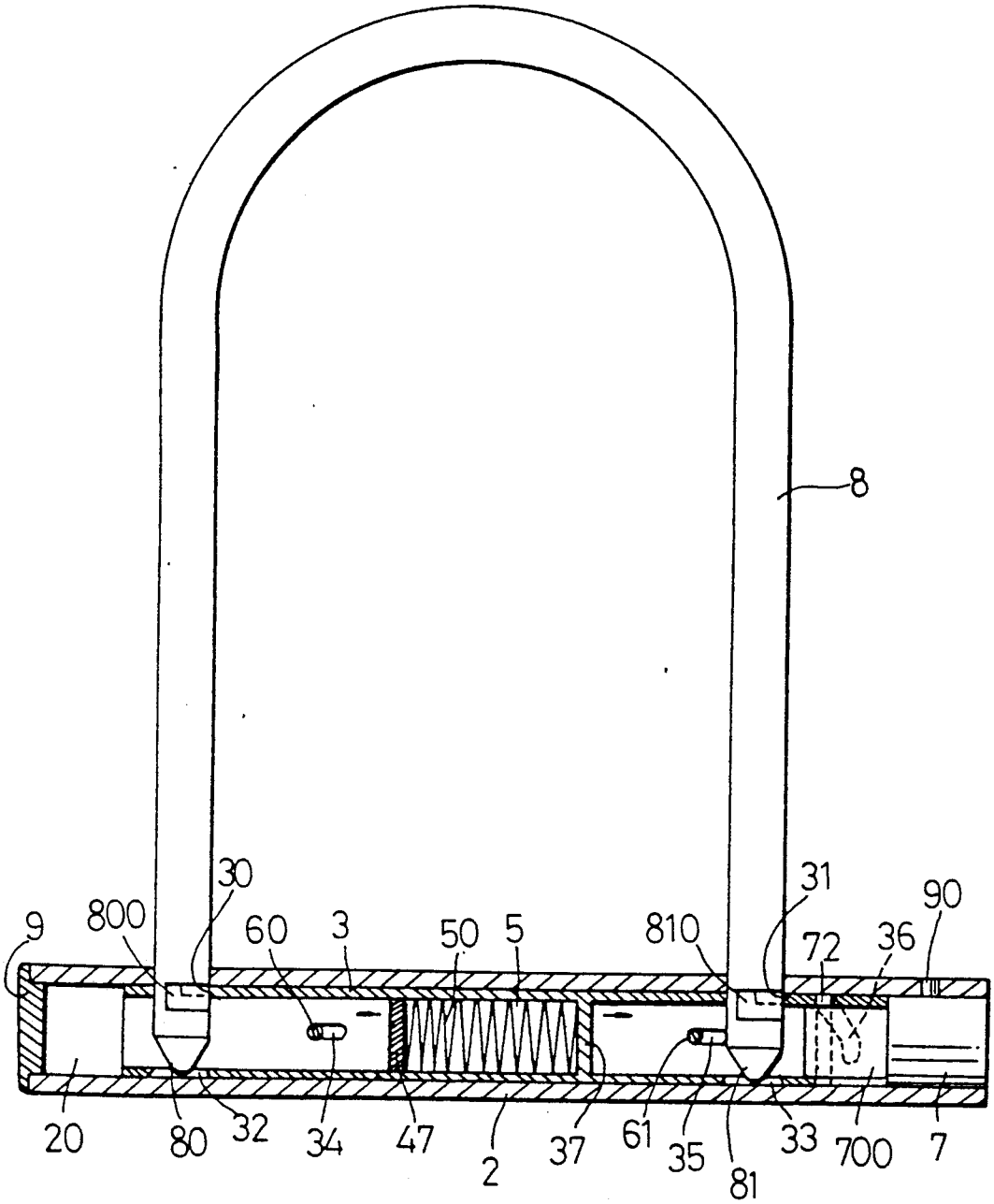
FIG. 5 is a cross-sectional view of the cylindrical lock with a shackle in locked position in the present invention.

In using, as shown in FIG. 5, the two ends with the cone-shaped surfaces 80, 81 of the shackle 8 are to be pressed into the shackle holes 21, 22 of the housing 2, letting the cone-shaped surfaces 80, 81 slide down along the stopping edges 300, 400, 310, 410 of the notches 30, 40, 31, 41. Then the two semi-round elongate plates, 3, 4 are moved in opposite direction—the plate 3 to the left and the plate 4 to the right—permitting the shackle 8 smoothly move down. Then elasticity of the spring 51 will force the stopping edges 300, 400, 310, 410 of the two elongate plates 3, 4 quickly fit in the inclined notches 800, 801, 810, 811, of the shackle 8, locking the shackle 8 in an immovable position. Thus, this lock is locked without using a key.

Figure 6:
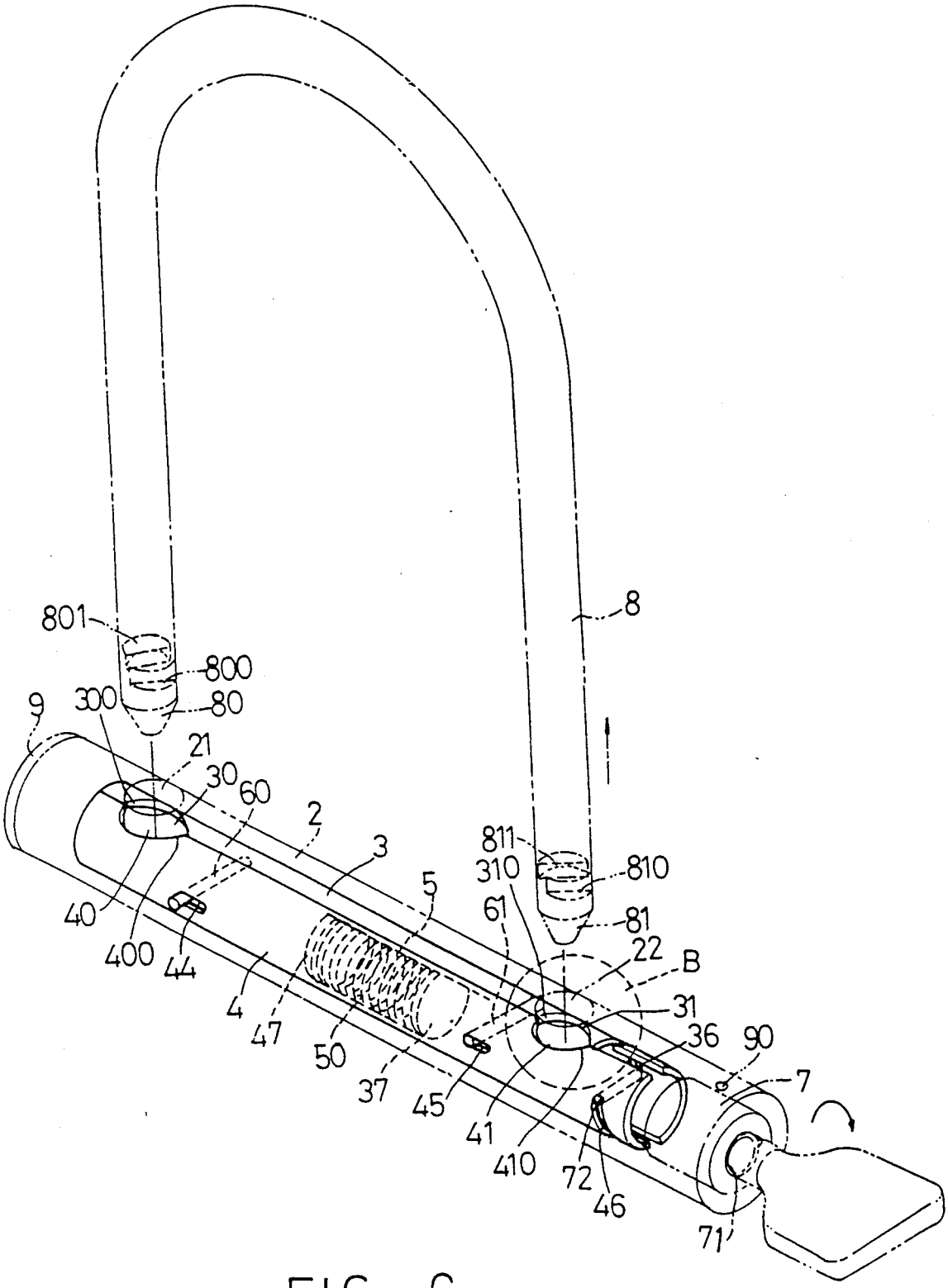
FIG. 6 is a cross-sectional view of the cylindrical lock with the shackle in unlocked position in the present invention.
Figure 7:
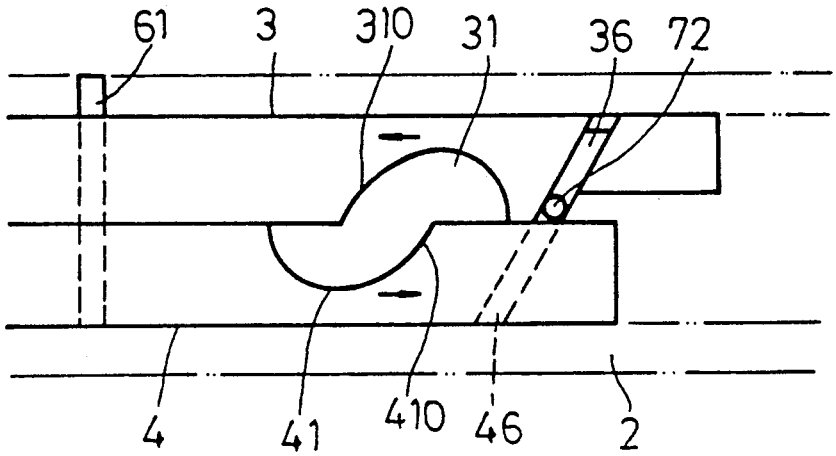
FIG. 7 is a front view of two semi-round elongate plates in locked position in the cylindrical lock in the present invention.
Figure 8:
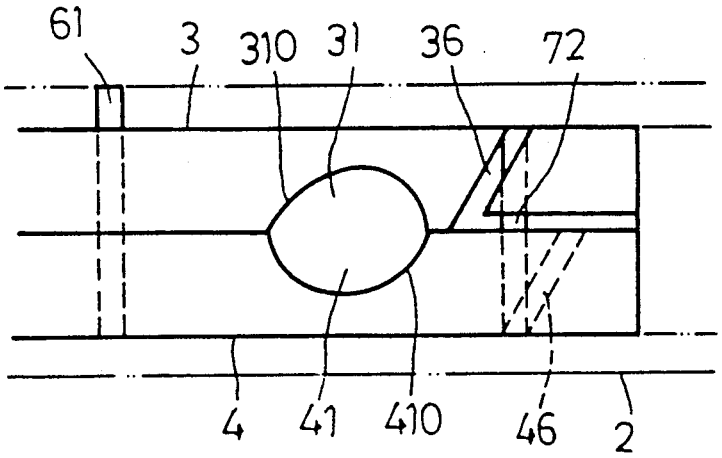
FIG. 8 is a front view of the two semi-round elongate plates in unlocked position in the cylindrical lock in the present invention.
Figure 9:
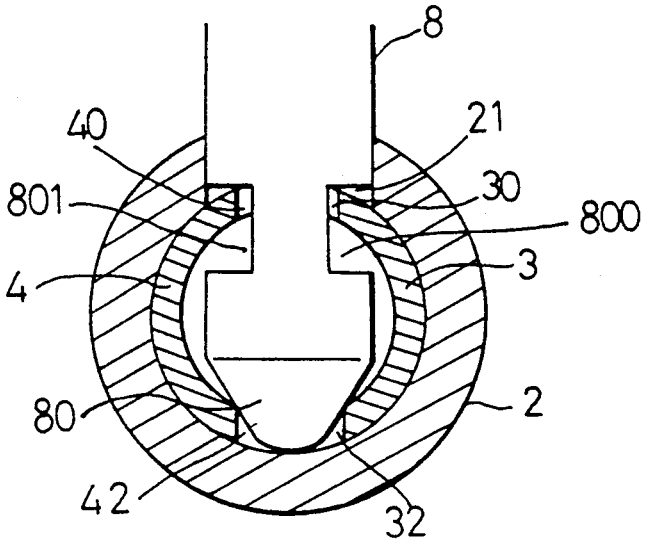
FIG. 9 is a magnified view of an A embodiment of the cylindrical lock in the present invention.
Figure 10:
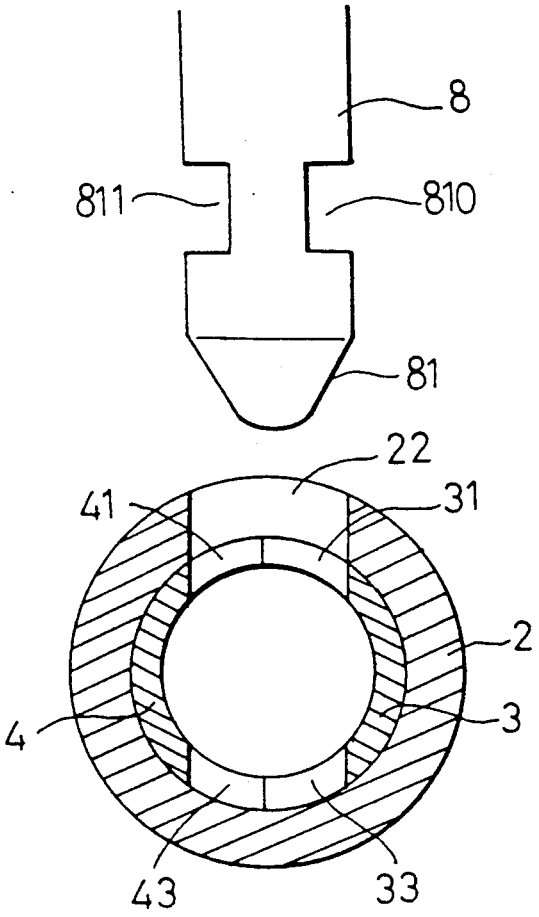
FIG. 10 is a magnified view of a B embodiment of the cylindrical lock in the present invention.

In case this lock is to be unlocked, as shown in FIG. 6, a key N is inserted in the key hole 71, and then turning member 70 is turned clockwise, making the projecting round block 700 rotate and forcing the slide pin 72 push the inclined grooves 36, 46 so that the semi-round elongate plate 3, 4 move in opposite direction i.e. the plate 3 to the left and the tube 4 to the right as shown in FIGS. 8 and 9. Then the stopping edges 300, 400, 310, 410 of the notches 30, 40, 31, 41 separate from the inclined notches 800, 801, 810, 811 of the shackle 8, which then becomes free to be taken off the housing 2. In the end, the key N has to be used to lock the lock member 70, in other words, to turn the turning member 70 counterclockwise, rotating the projecting round block 700 and forcing the slide pin 72 sliding along the inclined grooves 36, 46 to a locked position, and at the same time, the two elongate plates, 3, 4 are pushed by elasticity of the spring 51, forcing the stopping edges 300, 400, 310, 410 of the notches 30, 40, 31, 41 move back to the locked position. Then this lock is ready for the shackle 8 to insert in the housing 2 for locking.

What is claimed is:

1. A cylindrical lock comprising;

a cylindrical housing having a longitudinal through hole, two shackle holes spaced apart in line for two ends of a shackle to pass through in, a round hole for a locking pin to fix a lock member and two pin holes respectively in a rear portion and a front portion;

two round pins fitting in the two pin holes of the cylindrical housing;

a lock member shaped as a round post, deposited in a right end of the through hole of the housing and fixed firmly by the fixing pin inserted in the round hole of the housing, and having a turning member with a projecting round block extending rearward and an annular key hole in an outer end surface, the projecting round block having a lateral through hole for a slide pin to insert therein, the slide pin having both ends in contact with two inclined grooves in two semi-round elongate plates forming a complete tube deposited in the housing;

a shackle being U-shaped and having two ends shaped as a cone and two inclined notches provided above the ends for two stopping edges of the two elongate semi-round plates to engage;

a seal cap closing up a left end of the longitudinal through hole of the housing;

a locking pin inserting in the round hole of the housing to fix firmly the lock member in the through hole of the housing;

two semi-round elongate plates being combined to form a hollow tube to be deposited in the longitudinal through hole of the housing, and having two notches spaced apart and corresponding to each other in an upper and a lower edge, each said notch having a stopping edge positioned diagonally to that of the other corresponding notch, a slot respectively in a left portion and a right portion of each plate for two pins to pass through to keep the two elongate plates combined with the housing and to limit movement of the plates, an inclined groove between the right notch and the right end of each plate, a round stopper laterally fixed in each plate to form a chamber for depositing a coil spring resting on the stoppers therein after said two elongate semi-round plates are combined together to form a complete tube; and said two ends of the shackle being pushed into the two shackle holes of the housing in case the lock is to be locked, the cone-shaped surface of the said two ends gradually sliding and pushing the stopping edges of the notches in said two elongate semi-round plates so that said plates are moved in opposite directions until the stopping edges fit in and engage the inclined notches of the two ends of said shackle by elasticity of the spring in the chamber in the complete tube formed with said two elongate semi-round plates, said shackle then being kept locked in the housing by the two elongate plates, the lock being in locked position, said turning member of the lock member being turned with a key in case the lock is to be unlocked, said projecting round block being rotated together with the turning member forcing the slide pin to move along the inclined grooves of the two elongate plates so that said two plates move in opposite directions, said stopping edges of the notches in said plates then separating from the inclined notches of the shackle, which can then be taken off of the shackle holes of the housing with the two elongate plates being in unlocked position, said turning member of said lock member being turned from an unlocked position to a locked position so that the projecting round block is rotated, forcing the slide pin to slide along said inclined grooves back to the original lock position, and said stopping edges of said notches of the two plates are moved back to the original lock position pushed by the spring, ready for next locking.

* * * * *